US007327334B2

(12) United States Patent
Chen et al.

(10) Patent No.: US 7,327,334 B2
(45) Date of Patent: Feb. 5, 2008

(54) PLASMA DISPLAY PANEL DRIVER CIRCUIT HAVING TWO-DIRECTION ENERGY RECOVERY THROUGH ONE SWITCH

(75) Inventors: Bi-Hsien Chen, Ping-Tung Hsien (TW); Yi-Min Huang, Taipei (TW); Yi-I Lu, Tao-Yuan Hsien (TW); Yung-Chan Chou, Tao-Yuan Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 493 days.

(21) Appl. No.: 10/908,706

(22) Filed: May 24, 2005

(65) Prior Publication Data

US 2006/0267872 A1 Nov. 30, 2006

(51) Int. Cl.
*G09G 3/28* (2006.01)

(52) U.S. Cl. ..... 345/66; 345/63

(58) Field of Classification Search ..... 345/60, 345/63, 66, 76, 211, 212; 313/567; 315/169.3, 315/169.4

See application file for complete search history.

(56) References Cited

U.S. PATENT DOCUMENTS 5,670,974 A 9/1997 Ohba et al.
6,628,275 B2 * 9/2003 Vossen et al. ..... 345/211
6,768,270 B2 * 7/2004 Chae ..... 315/169.3
6,961,031 B2 * 11/2005 Lee et al. ..... 345/60
7,027,010 B2 * 4/2006 Lee ..... 345/60
7,123,219 B2 * 10/2006 Lee ..... 345/76
2003/0006716 A1 * 1/2003 Chae ..... 315/169.3
2003/0071578 A1 * 4/2003 Lee et al. ..... 315/169.3
2003/0173905 A1 * 9/2003 Lee et al. ..... 315/169.3
2006/0267874 A1 * 11/2006 Chen et al. ..... 345/68

* cited by examiner

*Primary Examiner*—Ricardo Osorio
(74) *Attorney, Agent, or Firm*—Winston Hsu

(57) ABSTRACT

A charging/discharging circuit of a plasma display panel (PDP) driver has a first inductance having a first end connected to the first side of the panel capacitor, a first diode having an anode coupled to a second end of the first inductance, a second diode having a cathode coupled to a cathode of the first diode, a second inductance having a first end coupled to an anode of the second diode and a second end connected to the second side of the panel capacitor, a third diode having a cathode coupled to the second end of the first inductance, a fourth diode having an anode coupled to an anode of the third diode and a cathode coupled to the first end of the second inductance, and a switch coupled between the cathode of the first diode and the anode of the third diode.

13 Claims, 6 Drawing Sheets

PLASMA DISPLAY PANEL DRIVER CIRCUIT HAVING TWO-DIRECTION ENERGY RECOVERY THROUGH ONE SWITCH

BACKGROUND OF INVENTION

1. Field of the Invention

The present invention relates to electronic display devices, and more specifically, to plasma display panel (PDP) driver circuits.

2. Description of the Prior Art

In a plasma display panel (PDP), charges are accumulated in cells according to display data, and a sustaining discharge pulse is applied to paired electrodes of the cells in order to initiate discharge glow to effect display. As far as the PDP display is concerned, a high voltage is required to be applied to the electrodes, and a pulse-duration of several microseconds is usually required. Hence the power consumption of a PDP display is considerable. Energy recovering (power saving) is therefore important. Many designs and patents have been developed for providing methods and apparatuses for energy recovery in PDPs. One example is taught in U.S. Pat. No. 5,670,974 ('974), entitled "Energy Recovery Driver for a Dot Matrix AC Plasma Display Panel with a Parallel Resonant Circuit Allowing Power Reduction" to Ohba et al., which is included herein by reference.

Please refer to FIG. 1 which illustrates a circuit diagram of a PDP driver circuit 100 according to the '947 patent. The PDP driver circuit 100 comprises an equivalent panel capacitor Cp having an X side and a Y side, four switches S1 to S4 for permitting current to pass as part of a voltage clamp circuit, and a charging/discharging circuit that includes two switches S5 and S6 with body diodes, two diodes D1 and D2, and an inductor L1. The PDP driver circuit 100 requires the two switches S5 and S6 in order to allow two-direction discharge, which is required for energy recovery. That is, the two switches S5 and S6 achieve two paths that allow ineffective power from the X side of the panel capacitor Cp to be recovered to the Y side and vice versa.

In operation, the switches S1 to S6 are controlled to provide panel capacitor Cp voltages as shown in FIG. 2. In plot 204, the individual voltages of the X side (dashed line) and Y side (solid line) of the panel capacitor Cp are shown to vary between 0 and Vs. Plot 202 shows the voltage across the panel capacitor Cp, which is the voltage of the Y side minus the voltage of the X side. The voltage across the panel capacitor Cp varies between Vs and −Vs.

The prior art suffers from several disadvantages. First, the requirement for two switches S5 and S6 increases the space required on a semiconductor integrated circuit. Second, the synchronized action the switches S5 and S6 requires increased complexity in related control circuits. And third, if only one switch fails, the circuit does not function properly. Other disadvantages and problems may also become apparent when depending on the application.

SUMMARY OF INVENTION

It is therefore a primary objective of the invention to provide a plasma display panel driver circuit that solves the problems of the prior art.

Briefly summarized, the invention includes a panel capacitor having a first side and a second side, a charging/discharging circuit connected in parallel with the panel capacitor, and a voltage clamp connected in parallel with the panel capacitor. The charging/discharging circuit comprises a first inductance having a first end connected to the first side of the panel capacitor, a first diode having an anode coupled to a second end of the first inductance, a second diode having a cathode coupled to a cathode of the first diode, a second inductance having a first end coupled to an anode of the second diode and a second end connected to the second side of the panel capacitor, a third diode having a cathode coupled to the second end of the first inductance, a fourth diode having an anode coupled to an anode of the third diode and a cathode coupled to the first end of the second inductance, and a switch coupled between the cathode of the first diode and the anode of the third diode.

It is an advantage of the invention that one switch allows for two-direction energy recovery along two paths.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
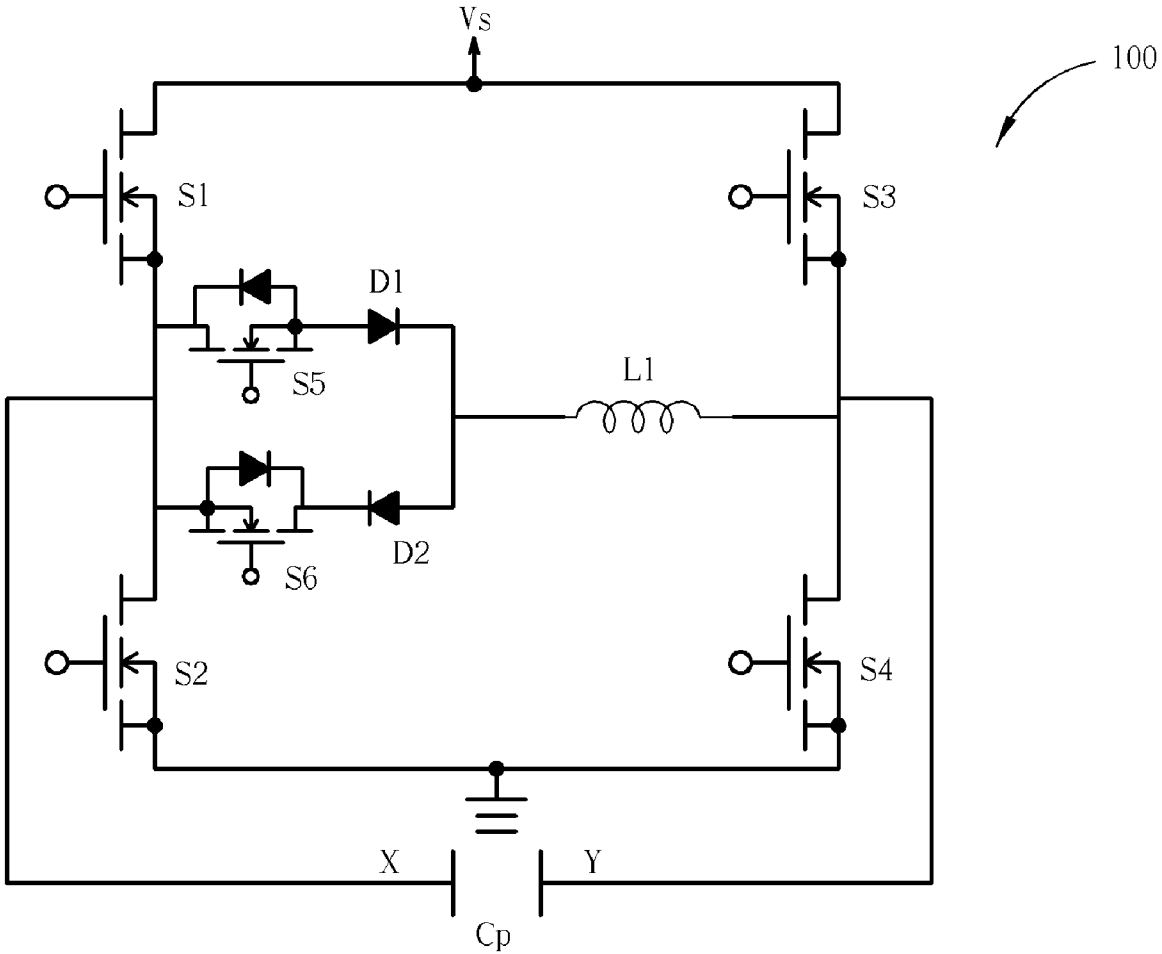
Fig. 1 Prior Art
FIG. 1 is a circuit diagram of a plasma display panel driver circuit according to the prior art.
Figure 2:
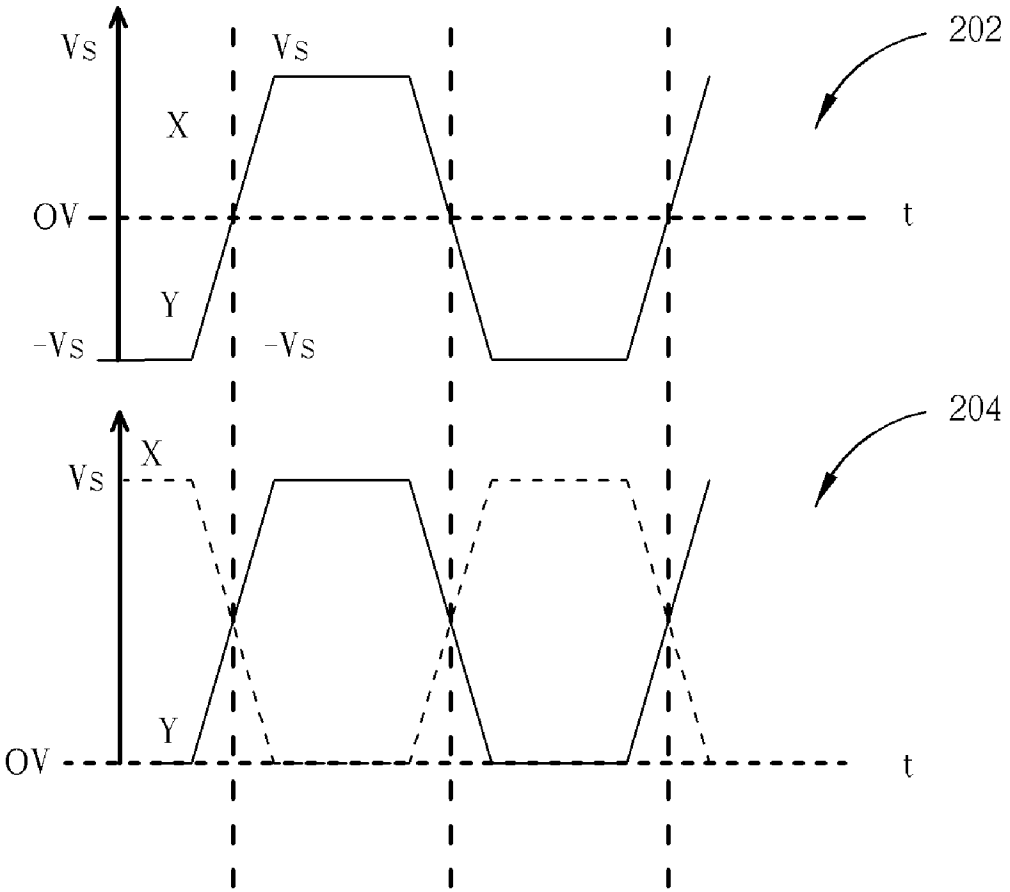
Fig. 2 Prior Art
FIG. 2 shows voltage levels in the circuit of FIG. 1 .
Figure 3:
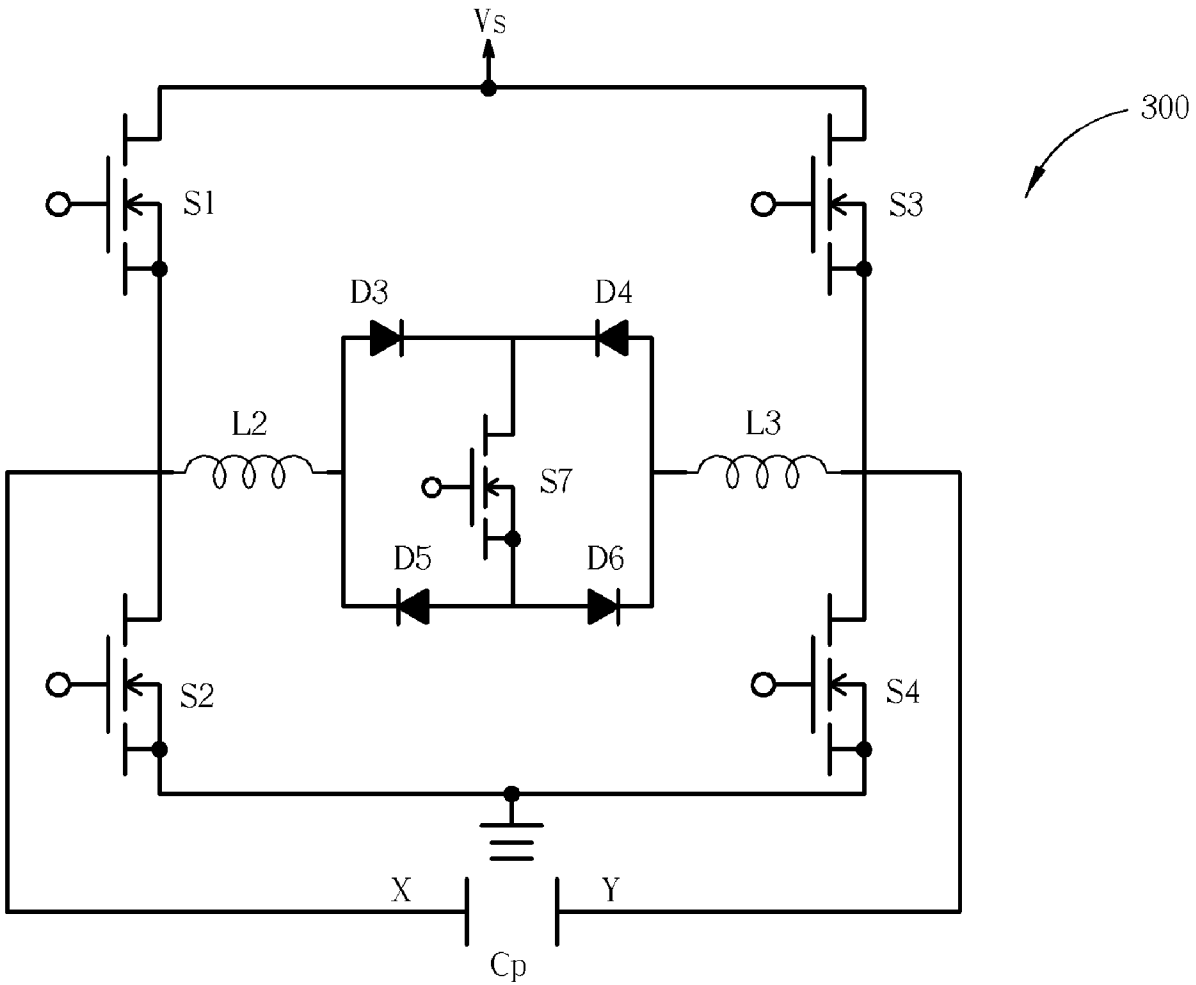
FIG. 3 is a circuit diagram of a plasma display panel driver circuit according to the present invention.

Please refer to FIG. 3 which illustrates a circuit diagram of a plasma display panel (PDP) driver circuit 300 according to the present invention. The PDP driver circuit 300 comprises an equivalent panel capacitor Cp having an X side and a Y side, four switches S1 to S4 as part of a voltage clamp circuit, and a charging/discharging circuit that includes a switch S7, four diodes D3, D4, D5 and D6, and two inductors L2 and L3.

The connections of the charging/discharging circuit are as follows. The inductor L2 has a first end connected to the X side of the panel capacitor Cp. The diode D3 has its anode connected to a second end of the inductor L2. The diode D4 has its cathode connected to the cathode of the diode D3. The inductor L3 has a first end connected to the anode of the diode D4 and a second end connected to the Y side of the panel capacitor Cp. The diode D5 has its cathode connected to the second end of the inductor L2. The diode D6 has its anode connected to the anode of the diode D5 and its cathode connected to the first end of the inductor L3. The switch S7 is connected between the cathode of the diode D3 and the anode of the diode D5. This arrangement of the switch S7, the diodes D3-D6, and the inductors L2 and L3 provides two one-way paths for two-direction discharge. In addition, as shown in FIG. 3, the switch S7 can be an N-type metal oxide semiconductor (MOS) transistor where the first end is the drain and the second end is the source. A PMOS transistor can also be used, as well as other types of devices such as an insulated-gate bipolar transistor (IGBT). Lastly, the designation of the panel capacitor Cp as having X and Y sides is arbitrary and the positions of the X and Y sides can be reversed.

The switches S1 to S4 of the voltage clamp are connected as follows. The switch S1 has its drain connected to a source voltage Vs and its source connected to the X side of the panel capacitor Cp, and the switch S2 has its drain connected to the X side of the panel capacitor Cp and its source connected to ground. Similarly, the switch S3 has its drain connected to the source voltage Vs and its source connected to the Y side of the panel capacitor Cp, and the switch S4 has its drain connected to the Y side of the panel capacitor Cp and its source connected to ground. As with the switch S7, other types of transistors can be used with simple, well-known differences in connection. Moreover, the source voltage Vs and ground are merely examples of voltages that can be used, and any other practical voltages can also be used.

Regarding the charging/discharging circuit, as mentioned, two one-way paths are provided for discharge of power on one side of the panel capacitor Cp to the other side, which allows for efficient energy recovery. The first path is as follows:

X side of Cp→L2→D3→S7→D6→L3→Y side of Cp, and, the second path is as follows:

Y side of Cp→L3→D4→S7→D5→L2→X side of Cp.

These two paths allow ineffective power from the X side of the panel capacitor Cp to be recovered to the Y side and vice versa for efficient energy recovery.

Figure 4:
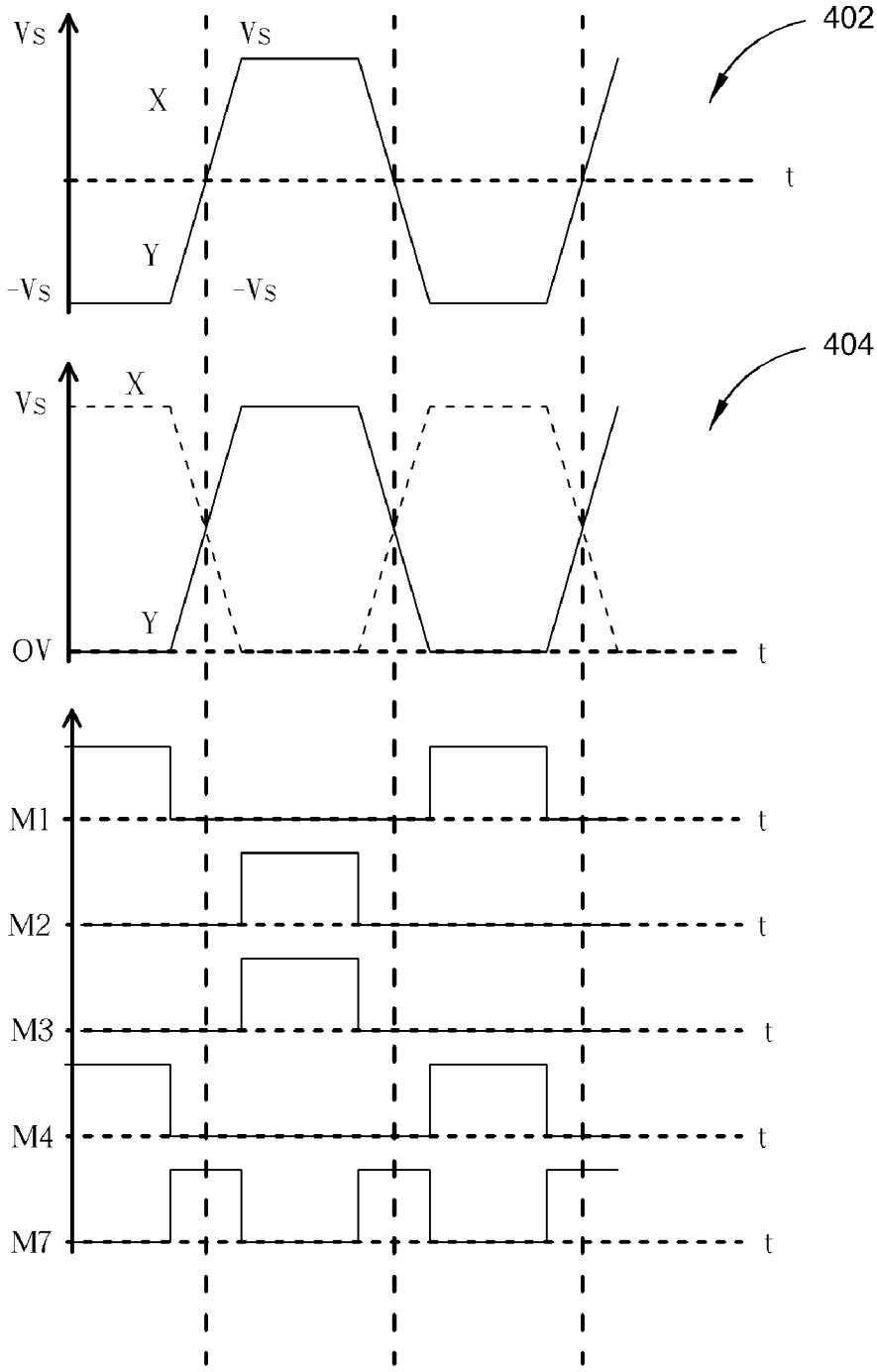
FIG. 4 shows voltage levels in the circuit of FIG. 3.

Please refer to FIG. 4 which shows voltage levels in the circuit 300 of FIG. 3 and control signals M1, M2, M3, M4 and M7 of the switches S1, S2, S3, S4 and S7, respectively. In FIG. 4, the horizontal axis represents time, while the vertical axis represents voltage potential. Note that each switch is designed to close (turn on) for permitting current to pass when the control signal is high, and to open (turn off) such that no current can pass when the control signal is low. The plot 404 shows voltage level on the side X (dashed line) and Y side (solid line) of the panel capacitor Cp, while the plot 402 shows the voltage across the panel capacitor Cp (i.e. Y minus X). The inductances of the inductors L2 and L3 control the rising and falling slopes of the voltage levels on the side X and Y side of the panel capacitor Cp. The switches S1 to S4 of the voltage clamp control the input energy from source voltage Vs to each side X and Y of the panel capacitor Cp. The switch S7 controls the energy recovery between the X and Y sides of the panel capacitor Cp.

When the switches S1 and S4 are closed/on (high level illustrated) so that current can flow through them and at the same time the switches S2 and S3 are open/off (low level illustrated), the PDP cell is lit up by the X side of the panel capacitor with voltage Vs while the Y side of the panel capacitor Cp is at 0 V (i.e. ground). At this time the voltage across the panel capacitor Cp is −Vs (i.e. 0−Vs). Conversely, when the states of the switches S1 to S4 are reversed, the voltage across the panel capacitor Cp is +Vs (i.e. Vs−0). According to the invention, during the transition period between the reversal of the states of the switches S1 to S4, the switch S7 is momentarily closed (turned on) such as to allow charge to move from the discharging side to the charging side of the panel capacitor Cp.

For example, during the first pulse of the switch S7 shown in FIG. 4, the charge on the X side of the panel capacitor Cp flows along the first one-way path (L2-D3-S7-D6-L3) to the Y side of the panel capacitor Cp, thereby reducing the subsequent amount of energy required from the source Vs to charge the Y side. Similarly, during the second pulse of the switch S7, the charge on the Y side of the panel capacitor Cp flows along the second one-way path (L3-D4-S7-D5-L2) to the X side of the panel capacitor Cp, to likewise effect energy recovery. In this way, two-direction energy recovery through one switch is achieved. However, it should be noted that the switching scheme described above is only an example, and different schemes can be applied depending on the application.

Figure 5:
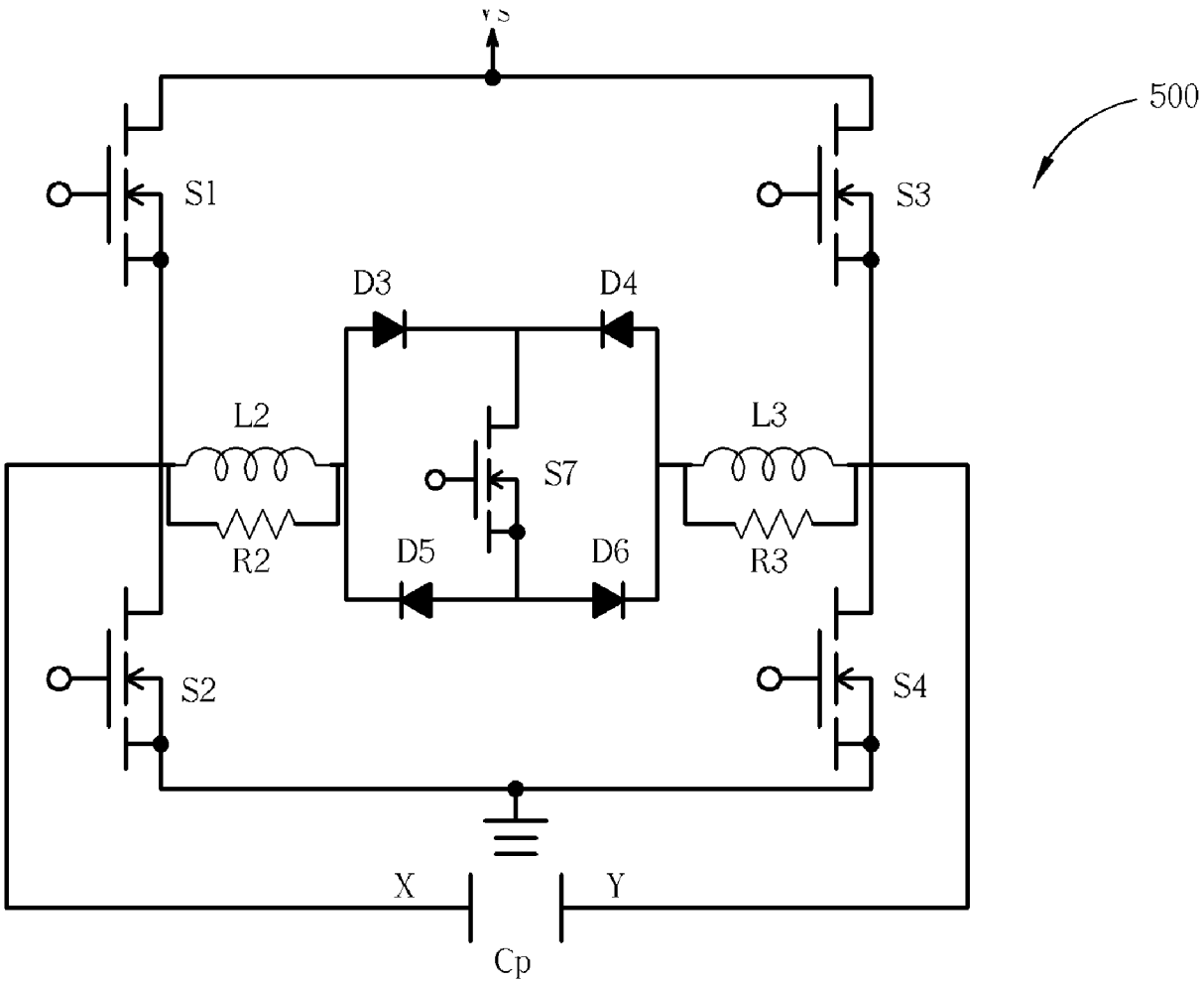
FIG. 5 is a circuit diagram of another embodiment of the present invention.

FIG. 5 is a circuit diagram of another embodiment of the present invention. A PDP driver circuit 500 is substantially the same as the PDP driver circuit 300 of FIG. 3, however, resistors R2 and R3 are provided in parallel with the inductors L2 and L3, respectively. This embodiment has an advantage of improved damping to maintain waveform shape.

Figure 6:
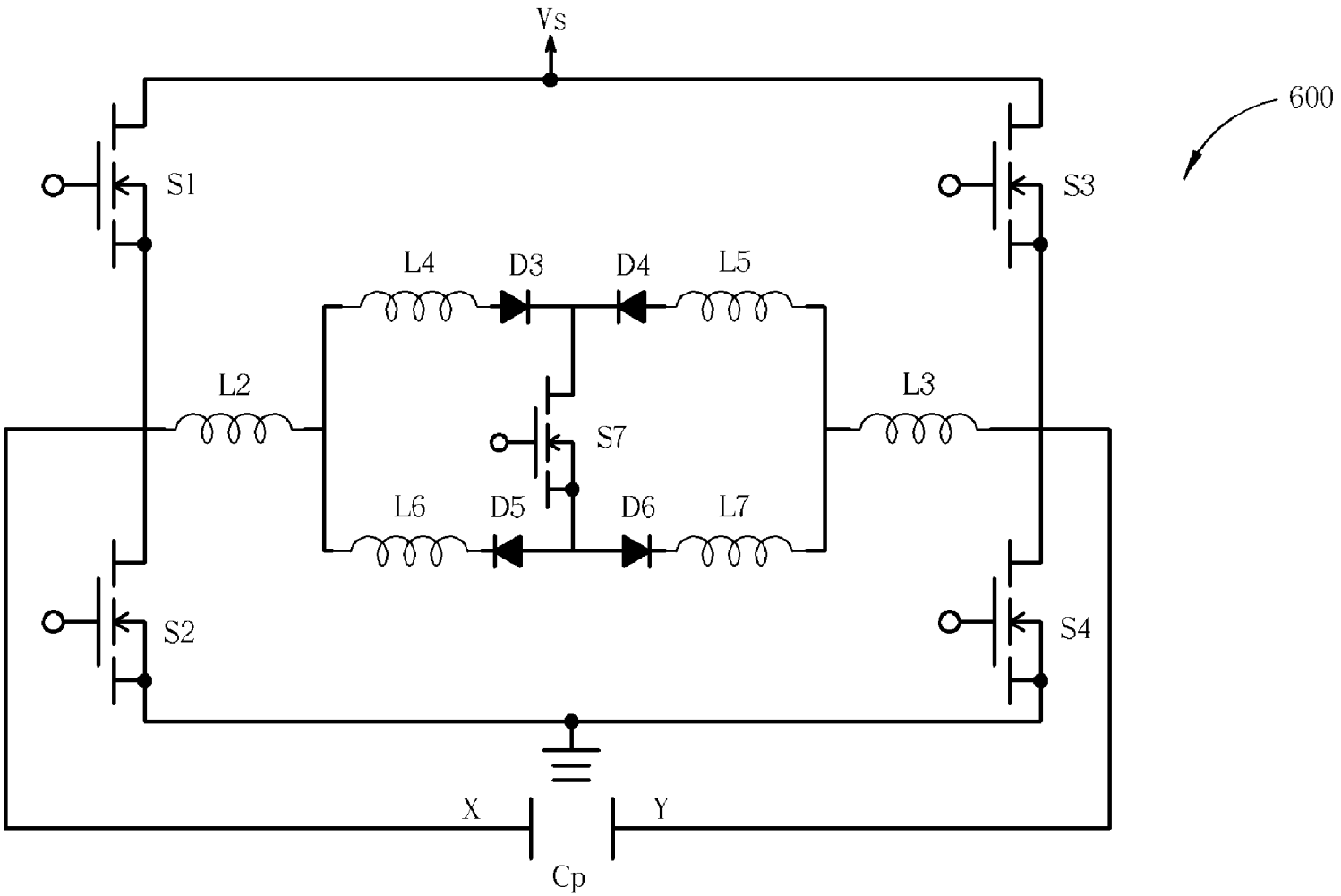
FIG. 6 is a circuit diagram of another embodiment of the present invention.

Please refer to FIG. 6 which illustrates another circuit diagram of a PDP driver circuit 600 according to the present invention. As with the previous embodiment, the PDP driver circuit 600 comprises an equivalent panel capacitor Cp having an X side and a Y side, four switches S1 to S4 as part of a voltage clamp circuit, and a charging/discharging circuit that includes a switch S7, and four diodes D3 to D6. A key difference of this embodiment is that there are six inductors L2 to L7 rather than two.

The connections of the charging/discharging circuit are substantially the same as in the previous embodiment except for the following. The inductor L4 is connected between the second end of the inductor L2 and the anode of the diode D3. The inductor L5 is connected between the anode of the diode D4 and the first end of the inductor L3. The inductor L6 is connected between the second end of the inductor L2 and the cathode of the diode D5. The inductor L7 is connected between the cathode of the diode D6 and the first end of the inductor L3. This arrangement of the switch S7, the diodes D3-D6, and the six inductors L2 to L7 provides two one-way paths for two-direction discharge.

Regarding the charging/discharging circuit, as in the previous embodiment, two one-way paths are provided for discharge of power on one side of the panel capacitor Cp to the other side. The first path is as follows:

X side→L2→L4→D3→S7→D6→L7→L3→Y side, and, the second path is as follows:

Y side→L3→L5→D4→S7→D5→L6→L2→X side.

These two paths allow ineffective power from the X side of the panel capacitor Cp to be recovered to the Y side and vice versa for efficient energy recovery.

In all embodiments of the invention, two common features are present. First, while there is only one switch S7 in the charging/discharging circuit, the charging/discharging circuit has two paths of discharge. Second, the inductances of the inductors can be selected to control the rising and falling slopes of the voltage levels on the side X and Y side of the panel capacitor Cp.

In contrast to the prior art, the present invention provides one switch that allows for two-direction energy recovery on two paths.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plasma display panel driver circuit comprising:

a panel capacitor having a first side and a second side;

a charging/discharging circuit connected in parallel with the panel capacitor, the charging/discharging circuit comprising:

a first inductance having a first end connected to the first side of the panel capacitor;

a first diode having an anode coupled to a second end of the first inductance;

a second diode having a cathode coupled to a cathode of the first diode;

a second inductance having a first end coupled to an anode of the second diode and a second end connected to the second side of the panel capacitor;

a third diode having a cathode coupled to the second end of the first inductance;

a fourth diode having an anode coupled to an anode of the third diode and a cathode coupled to the first end of the second inductance; and a first switch coupled between the cathode of the first diode and the anode of the third diode;

a voltage clamp connected in parallel with the panel capacitor.

2. The plasma display panel driver circuit of claim 1, wherein the charging/discharging circuit further comprises:

a third inductance coupled to the first diode in series;

a fourth inductance coupled to the second inductance in series;

a fifth inductance coupled to the third diode in series; and a sixth inductance coupled to the second inductance in series.

3. The plasma display panel driver circuit of claim 1, wherein the charging/discharging circuit further comprises a first resistance in parallel with the first inductance.

4. The plasma display panel driver circuit of claim 1, wherein the charging/discharging circuit further comprises a second resistance in parallel with the second inductance.

5. The plasma display panel driver circuit of claim 1, wherein the first switch is a P-type or N-type metal oxide semiconductor (MOS) transistor.

6. The plasma display panel driver circuit of claim 1, wherein the first switch is an insulated-gate bipolar transistor (IGBT).

7. The plasma display panel driver circuit of claim 1, wherein the voltage clamp comprises:

a second switch connected between a first voltage and the first side of the panel capacitor;

a third switch connected between a second voltage and the first side of the panel capacitor;

a fourth switch connected between a third voltage and the second side of the panel capacitor; and a fifth switch connected between a fourth voltage and the second side of the panel capacitor.

8. The plasma display panel driver circuit of claim 7, wherein the first voltage is larger than the second voltage.

9. The plasma display panel driver circuit of claim 7, wherein the third voltage is larger than the fourth voltage.

10. The plasma display panel driver circuit of claim 7, wherein the first voltage and the third voltage are different.

11. The plasma display panel driver circuit of claim 7, wherein the first voltage and the third voltage are the same.

12. The plasma display panel driver circuit of claim 7, wherein the second voltage and the fourth voltage are different.

13. The plasma display panel driver circuit of claim 7, wherein the second voltage and the fourth voltage are the same.

* * * * *